US006086463A

United States Patent [19]

Mattia

[11] Patent Number: 6,086,463

[45] Date of Patent: Jul. 11, 2000

[54] TESTER WITH INTERCHANGEABLE INSERTS FOR GRINDING WHEELS

[76] Inventor: Mauro Di Mattia, Via Carlo Porta, 92, 04011 Aprilia (LT), Italy

[21] Appl. No.: 09/199,633

[22] Filed: Nov. 25, 1998

[30] Foreign Application Priority Data

Nov. 28, 1997 [IT] Italy ..... RM97A0737

[51] Int. Cl.[7] ..... B24B 9/00

[52] U.S. Cl. ..... 451/237; 451/239; 451/240; 451/545

[58] Field of Search ..... 451/44, 237, 239, 451/246, 262, 267, 281, 282, 545

[56] References Cited

U.S. PATENT DOCUMENTS 2,693,063 11/1954 Dillon ..... 451/281
4,713,912 12/1987 Zoueki ..... 451/240
5,371,977 12/1994 Liner ..... 451/262
5,476,410 12/1995 Lupi ..... 451/44

FOREIGN PATENT DOCUMENTS 478518 4/1992 European Pat. Off. .
9401261 1/1994 WIPO .

*Primary Examiner*—M. Rachuba
*Attorney, Agent, or Firm*—Harrison & Egbert

[57] ABSTRACT

An apparatus for grinding edges of rigid materials including a support member, an upper grinding element rotatably mounted relative to the support member, a bearing affixed to the upper grinding element, a lower grinding element rotatably mounted relative to the support member, and an insert element removably affixed around the bearing and interposed between the support member and one of the upper and lower grinding elements. The insert element is of an annular configuration and has an outer diameter less than an outermost diameter of the grinding elements. The insert element is interchangeable with various other insert elements.

8 Claims, 2 Drawing Sheets

4a
2
1
5
4b

TESTER WITH INTERCHANGEABLE INSERTS FOR GRINDING WHEELS

TECHNICAL FIELD

The invention presented concerns a "tester device" made up of a support for the tester and an interchangeable insert. For clarity, a brief definition is given of it as a "tester". In the specific language, it is a mechanical element that, when placed on the rotating axle of a grinding wheel in operation, has the characteristic of not going beyond the depth of grinding desired, once it has come into contact with the material to be worked. By "interchangeable" is meant that the "insert" element, depending on the type of working or of material to be worked, can be changed. This is useful since the parts of the grinding wheel are of a highly abrasive material, while the tester is of a non-abrasive material, but one that does not abrade, so that the tester serves to keep the distance of the grinding wheel from the working surface constant. The invention takes its place in the field of applications of machines for the working of marbles, and other materials.

BACKGROUND ART

The testers known currently on the market are fixed testers, which are blocked and rotate with the same rotational speed as the grinding wheel even when in contact with the stone to be shaped. These testers suffer from wear resulting from the hammering impacts of the stone. Rotating testers (which rotate with the wheel) come in contact with the stone so as to be arrested, braking and rubbing against the material itself, while the grinding wheel goes on working. The disadvantage is that, owing to the inertia of the outer part of the tester, burns can form on the parts of the stone that first come into contact with the tester, with consequent deformation and wear of the tester itself. A spacer plate tester is used which is not in contact with the grinding wheel, but is inserted free in a groove, through an approach system mounted on the machine, since said plate is calibrated to strike against the stone to be worked. The difficulty with this system. is that, besides being more expensive than other types, in order to have a perfect shaping, the grinding machine must be positioned perfectly perpendicular to the surface to be worked, otherwise waves and trenches can be produced in the surface itself, depending on how the machine is positioned relative to the stone to be worked.

SUMMARY OF THE INVENTION

The invention presented, which marks a further step ahead in the specific technique, is now to be described for explanatory, and not imitative, purposes, reference being made to the version currently preferred by the inventor and on the basis of the attached figures of which a list follows.

DETAILED DESCRIPTION OF THE INVENTION

Figure 1:
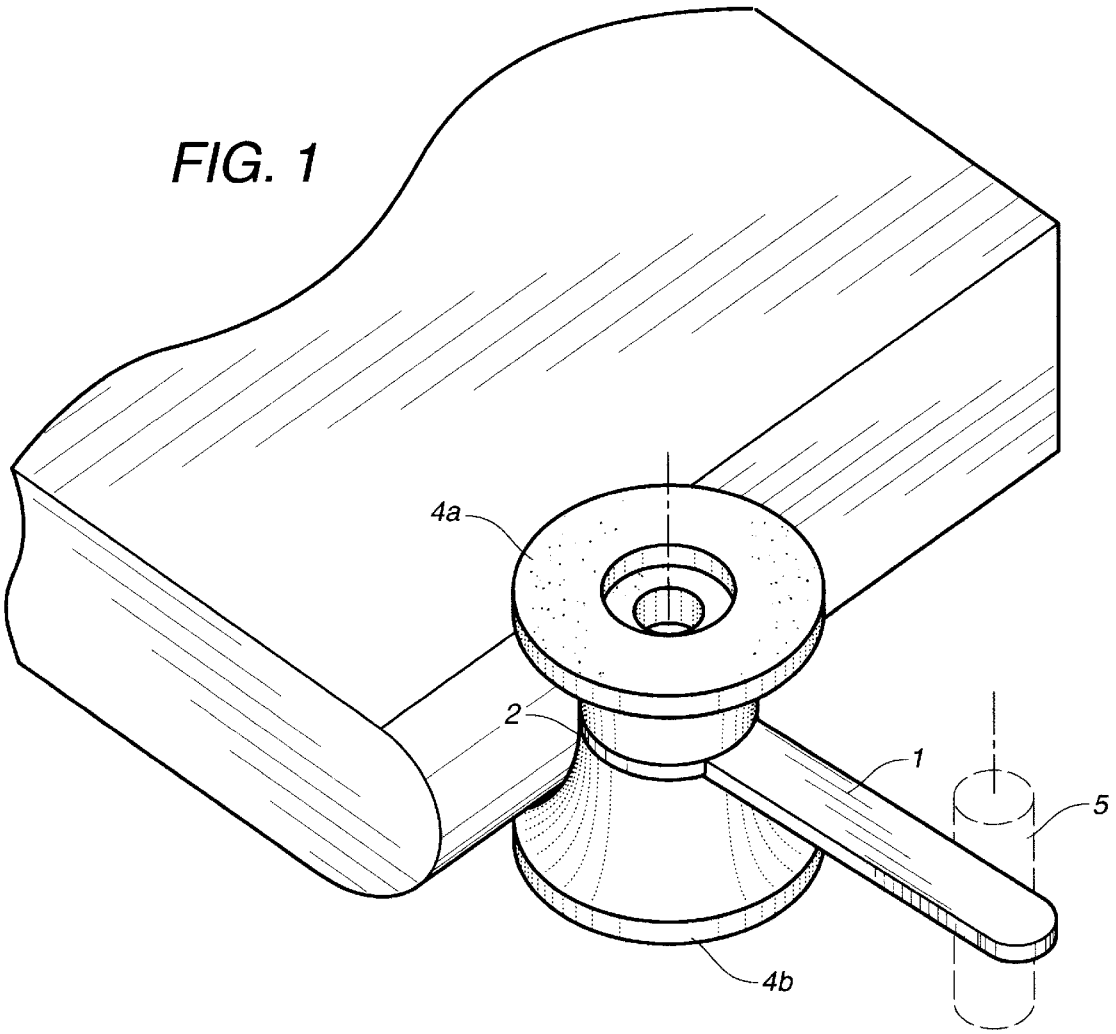
FIG. 1 is a schematic representation of the grinding wheel in which the support is inserted, with the interchangeable insert housed on the interior.
Figure 2:
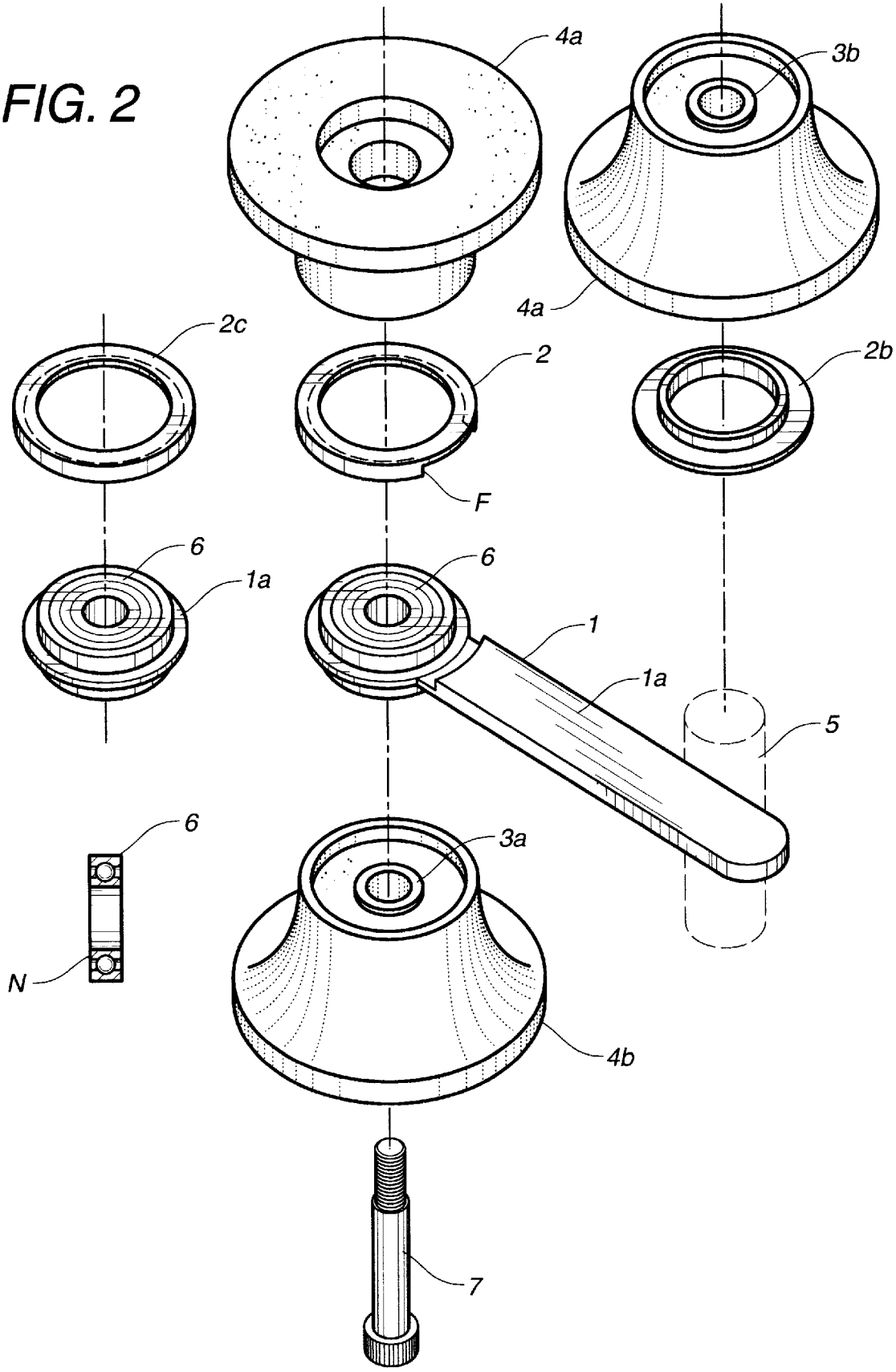
FIG. 2 is a schematic representation of the grinding wheel in which is housed the tester support and the interchangeable insert in an exploded view.

FIGS. 1 and 2 show the various components of the preferred embodiment of the present invention. The tester insert support 1 is equipped with a tongue extending outwardly therefrom. An interchangeable tester insert 2 is inserted in support 1 so that rotation is not possible when the support 1 comes into contact with the material to be machined. In this regard, an insert 2*b* (as shown in FIG. 2) can be inserted into the support 1 so as to allow rotation of the support 1 when the support 1 contacts the material to be machined. Also, an insert 2*c,* as illustrated in FIG. 2, can be inserted into the support 1 so as to allow rotation when a tongue is not used. Lock rings 3*a* and 3*b* (as shown in FIG. 2) can be used to secure one of the interchangeable inserts in place. The upper element 4*a* and the lower element 4*b* of the grinding wheel are shown in their desired relation to the material to be machined. FIG. 2 shows the upper element 4*a* from a bottom view. An anti-rotation support pin 5 is illustrated in broken line fashion abutting the tongue of support 1. Ball bearings 6 are shown in FIG. 2. A lock screw 7 is shown in FIG. 2 as securing the various components together. In FIG. 2, a tooth F is illustrated in a position suitable for preventing rotation of the insert 2. FIG. 2 also shows the central core N of the ball bearings 6.

The support 1 (FIG. 2) is a plate of suitable length that has ball bearings 6 attached at one end. The interchangeable insert 2 or 2*b,* which can have sundry configurations, is housed on the outside part of the element that contains the bearing 6 mounted on support 1. The tester insert 2 can be outfitted with a tooth F, which is the element that prevents rotation once applied on support 1 depending on whether it is desired to use a blocking system or not.

The interchangeable tester insert 2 is positioned on its support, by means of tooth F, which prevents its rotation, both when the grinding wheel turns and when it performs its unction in contact with the stone to be machined. The interchangeable tester insert 2*b,* when inserted in support 1, does not rotate when the grinding wheel turns, but only rotates when it comes into contact with the stone to be worked. The support 1 with the insert 2*b* accompanies the working with a motion of translation, thus not causing any wear and not damaging the material itself in any way.

In the support without tongue 1*a,* which has ball bearings 6 fixed on its interior, is inserted by housing in it the interchangeable tester insert 2*c*. This is another variation that can perform the function of tester. These versions achieve considerable economic savings both during use and during production. The interchangeable insert 2*c,* housed: on support 1*a,* (similar to insert 2*b,* lodged on support 1), since independent in the dragging of rotation both of support 1 and of bearing 6, when it is in contact with the stone to be worked, becomes independent of the inertia that causes its rotation, and begins to translate, accompanying the working, thus preventing the burning due to braking.

Elements 4*a* and 4*b,* respectively above and below the grinding wheel, retain the ball bearings 6 therebetween, and the whole remains fixed by means of rings 3*a* and 3*b,* which are so built as to contain the bearings 6, which in turn is inserted in support 1 which contains the interchangeable insert 2 or 2*c*. These interchangeable inserts 2, 2*b* and 2*c* carry out the testing function. The ball bearings 6, housed in support 1, has the task of making the support itself the rotation of the grinding wheels.

Bearings 6 available on the market and the grinding wheels, such as those shown at 4*a*–4*b,* have been in use, in various configurations, for a long time.

By means of support 1, the interchangeable insert 2 or 2*b* can be used for more than ¾ of its perfectly circular circumference. This permits its use with grinding machines that are not perfectly perpendicular to the material to be worked. This fact is another of the advantages offered over earlier techniques.

By shifting the point of support of support 1, by means of pin 5 on the machine, the interchangeable tester insert 2 or 2*b* works in any direction over the 360° of the plane. The interchangeable insert 2 or 2*b* or 2*c* can be made of any material, whether metal, glass, ceramic, etc., and may take on different configurations depending on the use to be made of it. The invention displays significant advantages costwise and in the simplicity of its use and manufacture. Furthermore, owing to its structure it is easier to use in comparison with earlier techniques.

What is claimed is:

1. An apparatus for grinding edges of rigid materials comprising:

a support member;

an upper grinding element rotatably mounted relative to said support member, said upper grinding element having a lock ring affixed thereto;

a bearing affixed to said locking ring of said upper grinding element;

a lower grinding element rotatably mounted relative to said support member, said lower grinding element having a lock ring affixed thereto; and an insert element removably affixed around said bearing and interposed between said support member and one of said upper and lower grinding elements, said insert element being of an annular configuration and having an outer diameter less than an outermost diameter of said upper and lower grinding elements.

2. The apparatus of claim 1, said insert element having said bearing received interior thereof.

3. The apparatus of claim 1, said insert element having a tongue extending outwardly therefrom.

4. The apparatus of claim 1, said insert element having a locking tooth formed thereon, said locking tooth for preventing complete rotation of said insert element with respect to said upper and lower grinding elements.

5. The apparatus of claim 1, said bearing being affixed to said locking ring of said lower grinding element.

6. The apparatus of claim 1, said upper grinding element having an outer surface adapted to grind an edge of the rigid material, said lower grinding element having a lower surface adapted to grind another edge of the rigid material, said insert element being positioned between the edges.

7. The apparatus of claim 1, said insert element being rotatable with said upper and lower grinding elements.

8. The apparatus of claim 1, further comprising a lock screw extending through an interior of said upper and lower grinding elements and an interior of said bearing and an interior of said insert element so as to secure said upper and lower grinding elements and said bearing and said insert element in sandwiched relationship.

* * * * *

UNITED STATES PATENT AND TRADEMARK OFFICE

CERTIFICATE OF CORRECTION

PATENT NO. : 6,086,463
DATED : July 11, 2000
INVENTOR(S) : DI MATTIA, Mauro

It is certified that error appears in the above-identified patent and that said Letters Patent is hereby corrected as shown below:

The Heading of the Patent should list the inventor's last name as "Di Mattia" instead of "Mattia".

Signed and Sealed this

Eighth Day of May, 2001

*Attest:*

Nicholas P. Godici

NICHOLAS P. GODICI

*Attesting Officer*

*Acting Director of the United States Patent and Trademark Office*